US006551429B1

(12) United States Patent
McAlpine

(10) Patent No.: US 6,551,429 B1
(45) Date of Patent: Apr. 22, 2003

(54) METHOD OF MAKING A FIBERGLASS DASHERBOARD

(75) Inventor: Franklin D. McAlpine, Boca Raton, FL (US)

(73) Assignee: McCourt North Construction Company, Boca Raton, FL (US)

( * ) Notice: Subject to any disclaimer, the term of this patent is extended or adjusted under 35 U.S.C. 154(b) by 141 days.

(21) Appl. No.: 09/609,349

(22) Filed: Jul. 5, 2000

Related U.S. Application Data

(62) Division of application No. 09/135,501, filed on Aug. 17, 1998, now Pat. No. 6,106,401.

(51) Int. Cl.[7] ..... A63C 19/00

(52) U.S. Cl. ..... 156/157; 156/285; 472/92; 52/782.1; 52/793.1

(58) Field of Search ..... 156/157, 243, 156/244.12, 285, 286, 324; 472/92, 88, 89; 256/24, 25, 73; 428/68, 69, 71, 76; 52/506.01, 782.1, 783.1, 784.14, 793.1; 264/241, 319, 328.1

(56) References Cited

U.S. PATENT DOCUMENTS

| | | | | |
|---|---|---|---|---|
| 3,727,888 A | | 4/1973 | Nickolas | 256/24 |
| 3,844,539 A | | 10/1974 | Abbott | 256/24 |
| 3,883,120 A | | 5/1975 | Tippmann | 256/24 |
| 4,025,686 A | | 5/1977 | Zion | 428/310 |
| RE30,984 E | | 6/1982 | Hipchen et al. | 428/297 |
| 4,469,733 A | | 9/1984 | Seddon | 428/109 |
| 4,798,763 A | | 1/1989 | Kia | 428/285 |
| 4,883,267 A | | 11/1989 | Burley | 272/3 |
| 4,905,970 A | | 3/1990 | Holmsten et al. | 256/24 |
| 4,927,134 A | | 5/1990 | Burley | 272/3 |
| 5,589,243 A | * | 12/1996 | Day | 428/316.6 |

* cited by examiner

*Primary Examiner*—Michael W. Ball
*Assistant Examiner*—Jessica Rossi
(74) *Attorney, Agent, or Firm*—Sheridan Ross P.C.

(57) ABSTRACT

This invention is directed to a structural laminate for use as a dasher board comprising a first layer of fiberglass, a layer of rigid foam made of polyvinylchloride, a first bonding layer operatively arranged to bond with the first fiberglass layer and the foam layer, a second layer of fiberglass, and a second bonding layer operatively arranged to bond with the second fiberglass layer and the foam layer. The invention is also directed to a method of making the structural laminate, comprising the steps of bonding a first layer of fiberglass to a foam layer; bonding a second layer of fiberglass to the foam layer; and sealing the bonded layers of fiberglass and foam. The invention is further directed to a dasher board system for use in enclosing an athletic playing field comprising a flat playing surface resting on dirt; the playing surface comprising a layer of asphalt on top of a layer of rock; a plurality of dasher boards; plurality of spaced apart horizontal short and long posts, the posts operatively connected to the dasher boards so as to support the dasher boards, the short posts alternating with the long posts, a plurality of spaced apart footers flush with and extending down from the asphalt layer through the rock layer into the dirt; the posts fixedly anchored to the footers; a plurality of brackets; the brackets fixedly connecting the dasher boards so that the connected dasher boards are vertically upright.

4 Claims, 2 Drawing Sheets

METHOD OF MAKING A FIBERGLASS DASHERBOARD

CROSS-REFERENCE TO RELATED APPLICATIONS

This application is a division and claims priority to U.S. patent application, Ser. No. 09/135,501, filed Aug. 17, 1998, now U.S. Pat. No. 6,106,401.

FIELD OF THE INVENTION

This invention relates generally to structural laminates for use as wall enclosures around athletic playing surfaces. The invention relates specifically to a structural laminate suitable for use in a system of interconnected dasher board panels for use in outdoor or indoor hockey or skating rinks.

BACKGROUND OF THE INVENTION

The use of structural laminates for hockey dasherboard systems is well known. Everyone who has seen a hockey game in person or on television can recognize that hockey dasherboards have to be able to withstand body checks, pucks flying and thousands of impacts over the course of the dasherboard systems life span while keeping the players and the puck inside the rink. It is, therefore, logical that a hockey dasherboard system must be made of strong materials, yet lightweight enough to be removed in between hockey games.

Typical dasherboard structural laminates work very well for use with indoor hockey rinks. However, Southern and Southwestern states do not have year-round hockey rinks as do some Northern states, making it difficult for players to maintain hockey playing condition throughout the year. The trend in the Southern and Southwestern states is to play hockey outdoors. With the advent of in-line roller skates, outdoor hockey has become a significant trend with intramural leagues and other playing leagues sprouting up and becoming very popular. Outdoor hockey rinks typically do not have protection from the elements, such as sun, heat, wind, and rain. For this reason, typical hockey dasherboards do not work well under the unrelenting sunshine and soaring temperatures and humidity that are typical of most Southern and Southwestern states. Typical hockey dasherboards stop functioning and tend to degrade over time when exposed to such extreme elements and, in some instances, begin to melt. This is, of course, extremely dangerous not only for the outdoor hockey players but the spectators of such events.

SUMMARY OF THE INVENTION

This invention is directed to a structural laminate for use as a dasherboard comprising a first layer of fiberglass, a layer of rigid foam made of polyvinylchloride, a first bonding layer operatively arranged to bond with the first fiberglass layer and the foam layer, a second layer of fiberglass, and a second bonding layer operatively arranged to bond with the second fiberglass layer and the foam layer. The invention is also directed to a method of making the structural laminate, comprising the steps of bonding a first layer of fiberglass to a foam layer, bonding a second layer of fiberglass to the foam layer; and sealing the bonded layers of fiberglass and foam. The invention is further directed to a dasher board system for use in enclosing an athletic playing field comprising a flat playing surface resting on dirt, the playing surface further comprising a layer of asphalt on top of a layer of rock; a plurality of dasher boards, a plurality of spaced apart horizontal short and long posts, the posts operatively connected to the dasher boards so as to support the dasher boards, the short posts alternating with the long posts, a plurality of spaced apart footers flush with and extending down from the asphalt layer through the rock layer into the dirt, the posts fixedly anchored to the footers; a plurality of brackets; the brackets fixedly connecting the dasher boards so that the connected dasher boards are vertically upright.

It is an object of this invention to provide a new structural laminate for use with hockey dasherboard systems that is suitable for both indoor and outdoor use.

It is an additional object of this invention to provide a new structural laminate for use with hockey dasherboard systems that is especially suited to outdoor use, able to withstand the effects of sun and high temperatures as well as cold temperatures.

It is a further object of this invention to provide a structural laminate that is strong, yet thin and lightweight for easy construction and deconstruction.

It is a further object to provide a method for making such a structural laminate.

Other objects, features and advantages of the present invention will become apparent from the following detailed descriptions of the preferred embodiments when taken in conjunction with the accompanying drawings.

DETAILED DESCRIPTION OF THE PREFERRED EMBODIMENT

Figures 1, 1A:
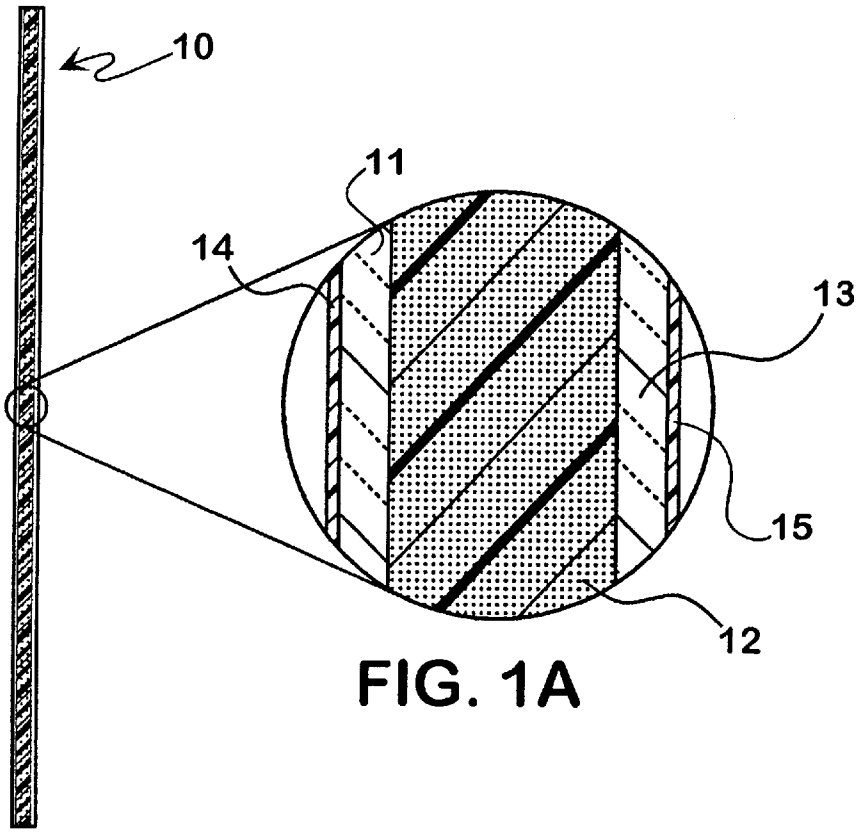
FIG. 1 depicts a side elevational cross-sectional view of the structural laminate used in the invention.
FIG. 1A depicts an exploded view of a portion of the structural laminate.

With reference to the drawings in detail, for the ease of the reader, like reference numerals designate identical or corresponding parts throughout the views depicted in the drawings. In the preferred embodiment, the structural laminate (10) has elemental layers: a first fiberglass layer (11), a polyvinylchloride (PVC) foam layer (12), and a second layer of fiberglass (13). For aesthetic purposes, in a more preferred embodiment, the structural laminate also includes a first and second layer of gel coat (14 and 15, respectively). The structural laminate is formed by bonding together the first layer of fiberglass (11) to the PVC foam layer (12), preferably with a type of bonding glue or cement that is rated for use in areas with high temperatures and humidity. The second layer of fiberglass (13) is then bonded to the exposed side of the PVC foam layer. Once both layers of fiberglass are initially bonded to the PVC foam layer, the entire sandwich is vacuum sealed. Vacuum sealing evenly spreads the pressure across the surfaces of the PVC foam layer. In a more preferred embodiment, a first layer of gel coat (14) is applied to the exposed side of the first layer of fiberglass (11). A second layer of gel coat (15) is applied to the exposed side of the second layer of fiberglass (13). Any suitable gel coat may be used; however, it must be rated to withstand exposure to ultraviolet light.

The structural laminate as described above has a total thickness of approximately 1¾ inches. In the most preferred embodiment, each gel coat has a thickness of approximately 1/16 of an inch. Each fiberglass layer has a thickness of approximately 1/8 of an inch. The PVC foam core has a thickness of approximately 1 and 3/16 of an inch.

In the preferred embodiment, the structural laminate described above is used as part of a hockey dasherboard system for surrounding a hockey rink. The invention, for convenience, will be described with reference to an outdoor hockey rink; although the reader should bear in mind that the hockey dasherboard system, with slight modifications, will work equally well in indoor rinks. The hockey dasherboard system rests on a bed of rock (38) into which footers (35) are placed for providing anchorage of the dasherboard system to the ground. On top of the rock is a thin layer of asphalt (39) that is used as the playing surface for an outdoor hockey rink. Extending upward from each of the footers (35) is either a short post (31) or a long post (32). Both the short and long posts are fixedly attached to the footers. A short post is, most preferably, approximately 4 feet in height. A long post is, most preferably, approximately, 8 feet in height. The short and long posts alternate around the rink, except where access doors are to be placed. At the location where access doors are to be placed, two long posts will be adjacent to one another. The short and long posts provide support for the boards (10) which are made of the structural laminate described above. The boards (10) are attached to the posts through any permanent attachment method. In the preferred embodiment, the boards (10) are permanently fixed to the posts via brackets (33). The bottom edge of the board (10) is flush with the asphalt (39) so as to prevent any item, such as the hockey puck, from escaping from the rink. As one ca envision, most of the wear and tear that a dasherboard system endures is concentrated around the bottom foot of the boards. To provide extra protection against such wear and tear along the bottom edge of the boards (10), a protective material is bonded to the gel coat layer of the boards. The preferred protective material is ultra-high density polyurethane (UP). The protective material is approximately one foot in height and is usually a bright color, such as red or yellow.

Figure 2:
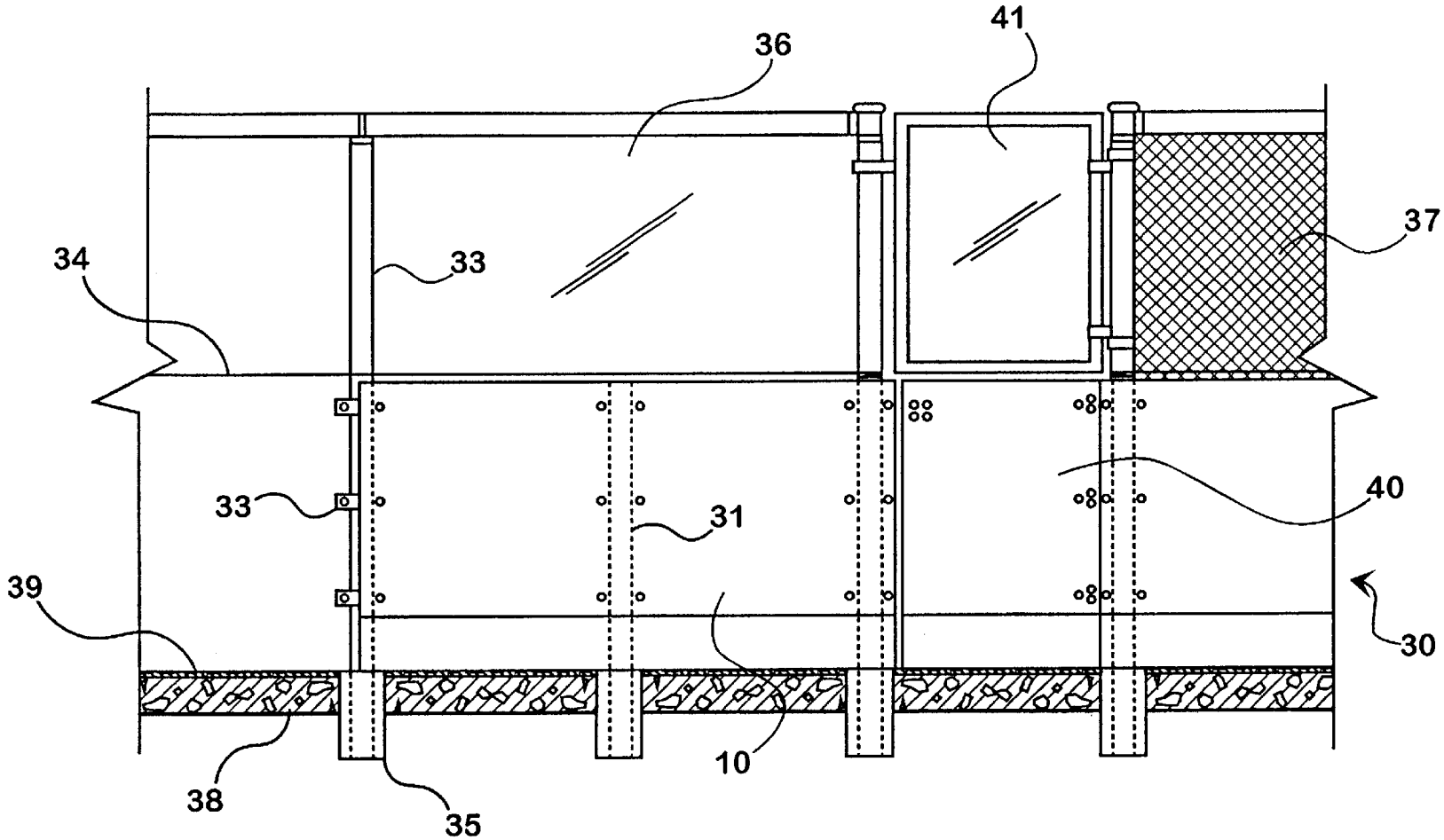
FIG. 2 depicts a front elevational view of how the structural laminate is used in conjunction with a hockey dasherboard system.

A tension wire extends from one of the long posts (32) near an access door (40) around the rink to another long post near a different access door (not shown on the drawings). The tension wire does not cross an access door or area. The tension wire is above the boards (10) but not contiguous with the boards (10). Resting on the tension wire and permanently affixed to the long posts (32) are sheets of plexiglass (36) for providing viewing access of the events occurring in the rink. A sheet of plexiglass (36) extends between two long posts (32) as shown in FIG. 2. As an alternate embodiment, mesh netting (37) may be used to replace the plexiglass (36). If mesh netting is used, 6 gauge mesh is most preferred. The mesh netting extends between two long posts (32) like the sheet of plexiglass.

The access door (40) is provided with the hockey dasherboard system to provide ingress and egress from the playing surface. The door is pivotably connected to long posts (32) such that the door will open in only one direction. A latch (not shown) is provided to keep the door closed while the hockey game is being played. An access window (41) is also pivotably connected to the long posts (32) above the access door (40). Typically, in any hockey dasherboard system, more than one access door and window combination is provided.

Although the invention is described by reference to a specific preferred embodiment, it is obvious to one skilled in the art that variations can be made without departing from the spirit of the invention as claimed.

What I claim is:

1. A method of making a hockey dasherboard, comprising:

bonding a first layer of fiberglass to a foam layer;

bonding a second layer of fiberglass to the foam layer;

sealing the bonded first and second layers of fiberglass and foam.

2. A method of making a hockey dasherboard, comprising:

bonding a first layer of fiberglass to a foam layer;

bonding a second layer of fiberglass to the foam layer;

vacuum sealing the bonded first and second layers of fiberglass and foam.

3. The method according to claim 1 further comprising:

applying a gel coat to the first layer of fiberglass; and, applying a gel coat to the second layer of fiberglass.

4. The method according to claim 2 further comprising:

applying a gel coat to the first layer of fiberglass; and, applying a gel coat to the second layer of fiberglass.

* * * * *